US010648252B2

(12) United States Patent
Bouaphanh

(10) Patent No.: US 10,648,252 B2
(45) Date of Patent: May 12, 2020

(54) REMOTE OPERATED VEHICLE REMOVABLE FLEXIBLE JOINT ELASTOMER PROTECTION TOOL

(71) Applicant: OIL STATES INDUSTRIES, INC., Arlington, TX (US)

(72) Inventor: Inpeng Bouaphanh, Fort Worth, TX (US)

(73) Assignee: Oil States Industries, Inc, Arlington, TX (US)

( * ) Notice: Subject to any disclaimer, the term of this patent is extended or adjusted under 35 U.S.C. 154(b) by 0 days.

(21) Appl. No.: 15/944,425

(22) Filed: Apr. 3, 2018

(65) Prior Publication Data

US 2018/0305992 A1 Oct. 25, 2018

Related U.S. Application Data

(60) Provisional application No. 62/487,938, filed on Apr. 20, 2017.

(51) Int. Cl.

| | |
|---|---|
| ***E21B 19/16*** | (2006.01) |
| ***E21B 41/04*** | (2006.01) |
| ***E21B 17/02*** | (2006.01) |
| ***E21B 19/00*** | (2006.01) |
| ***E21B 43/01*** | (2006.01) |
| ***E21B 41/00*** | (2006.01) |

(52) U.S. Cl.

CPC ..... *E21B 19/16* (2013.01); *E21B 17/02* (2013.01); *E21B 19/004* (2013.01); *E21B 19/006* (2013.01); *E21B 41/0007* (2013.01); *E21B 41/04* (2013.01); *E21B 43/0107* (2013.01)

(58) Field of Classification Search

CPC ..... E21B 17/017; E21B 17/02; E21B 19/004; E21B 41/0007; E21B 41/04

See application file for complete search history.

(56) References Cited

U.S. PATENT DOCUMENTS 2,370,354 A * 2/1945 Hurst ..... F16L 37/20 285/311
3,870,345 A * 3/1975 Liautaud ..... E21B 33/038 166/338
4,131,296 A * 12/1978 Strader ..... B60D 1/02 280/477
5,333,691 A 8/1994 Dean et al.
(Continued)

OTHER PUBLICATIONS

Patent Cooperation Treaty, PCT/US2018/025910, International Search Report and Written Opinion, dated Jun. 14, 2018.

*Primary Examiner* — James G Sayre
*Assistant Examiner* — Aaron L Lembo
(74) *Attorney, Agent, or Firm* — Morgan, Lewis & Bockius LLP

(57) ABSTRACT

An improved flexible joint elastomer protection tool is described, which can be actuated and removed by a remote operated vehicle ("ROV"), the tool having pivot arms that can be rotated from a closed position to an open position. Rotation inward to the closed position results in the compression of the elastomeric component in an offshore flexible joint. Rotation outward to the open position results in the de-compression of the elastomeric component in an offshore flexible joint. Rotation of the arms can be accomplished using mechanical, hydraulic or other mechanisms that can be operated by an ROV.

25 Claims, 10 Drawing Sheets

(56) References Cited

U.S. PATENT DOCUMENTS

| | | | | |
|---|---|---|---|---|
| 6,845,815 | B2 * | 1/2005 | Hergarden | E21B 33/037 166/75.13 |
| 7,341,283 | B2 | 3/2008 | Moses et al. | |
| 8,317,234 | B2 | 11/2012 | McKay | |
| 9,587,446 | B2 | 3/2017 | Teichmiller et al. | |
| 2004/0216885 | A1 * | 11/2004 | Bartlett | E21B 33/038 166/343 |
| 2011/0209651 | A1 * | 9/2011 | Yemington | B63B 17/00 114/122 |
| 2012/0018164 | A1 | 1/2012 | Tabor et al. | |
| 2012/0292037 | A1 * | 11/2012 | Gutierrez | E21B 17/017 166/341 |
| 2014/0069657 | A1 * | 3/2014 | Povloski | E21B 17/015 166/345 |
| 2016/0281444 | A1 * | 9/2016 | Teichmiller | E21B 19/002 |
| 2018/0080590 | A1 * | 3/2018 | McKay | E21B 34/00 |
| 2019/0063164 | A1 * | 2/2019 | Carlsen | E21B 17/017 |

* cited by examiner

REMOTE OPERATED VEHICLE REMOVABLE FLEXIBLE JOINT ELASTOMER PROTECTION TOOL

BACKGROUND

1. Field of the Invention

The invention relates to offshore production elastomeric flexible joints and remote operated vehicle removable flexible joint elastomer protection tools.

2. Description of the Related Art

Elastomeric flexible joints and flexible joint elastomer protection tools have been used in the offshore petroleum industry for some time. Remote operated vehicles, commonly referred to as "ROVs" have also seen widespread use in the offshore petroleum industry.

An elastomeric flexible joint is often used to connect an offshore production or auxiliary pipeline or riser to a floating platform. Such joints can provide rotational compliance while containing flowline pressure and are well-known within the industry.

Prior to installation on a floating platform, riser components are often temporarily parked on the sea floor, often with an elastomeric flexible joint already installed on the riser. During this temporary parking on the sea floor, the hyperbaric pressure acting on the flexible joint can cause a rupture which may result in permanent damage and loss of sealing capability. For this reason, a special tool (referred to herein as a "flexible joint elastomer protection tool") is pre-installed on the flexible joint and provides compressive pre-loading of the flexible joint elastomer element, thus preventing a rupture in the elastomer while it is parked on the sea floor. In order for the flexible joint to provide rotational compliance during operation, however, the flexible joint elastomer protection tool must be removed once the riser and flexible joint have been lifted to the elevation necessary to be connected to the vessel.

The serviceability and ability to remove a flexible joint elastomer protection tool in or near the installed position of the flexible joint has been an issue known in the industry for years. Although ROVs are often used to perform various jobs related to risers, they have generally not been able to remove a flexible joint elastomer protection tool. One reason for this is that many flexible joint elastomer protection tool designs utilize jacking bolts that require up to 6,000 ft-lbs of torque to unload. The typical ROV that would be able to access the flexible joint elastomer protection tool in the installed position of the flexible joint is only capable of producing around 125 ft-lbs of torque, so ROVs are currently not able to remove conventional flexible joint elastomer protection tools. Accordingly, when flexible joint elastomer protection tool removal is required, the flexible joint must often be completely pulled out of the water to a work platform, where personnel can manually remove the tool with large wrenches or hydraulic torque wrenches. This is a costly and time intensive procedure. In addition, most of the cranes on floating platforms, such as floating production storage and offloading platforms (FPSOs), are not capable of lifting the flexible joint up to a working deck, and an additional installation vessel with a larger crane is thus often required, at a potentially significant extra cost. Eliminating the need to raise the flexible joint to the surface, possibly requiring an additional installation vessel, could potentially save installation contractors millions of dollars. Thus, it would be desirable to provide a flexible joint elastomer protection tool that can be removed by a typical ROV, rather than manually removed at the surface.

SUMMARY OF THE INVENTION

The principal function of a flexible joint elastomer protection tool is to apply a compression load on the flexible joint (abbreviated "FJ") flex element and maintain the compression load throughout the time prior to installation of the flexible joint, particularly while installed on a riser that is resting on the sea floor. Because the flex element is extremely stiff in the axial direction, only a small displacement is needed to achieve the required compression, typically less than 0.25 inches.

Embodiments of the invention described herein utilize a camming action to transform the rotating action of a pivot arm into an axial displacement on the flexible joint extension. This action in turn, compresses or decompresses the flex element as needed. The pivot arm also serves as a lever arm, which can amplify the rotation force.

After installation of the flexible joint elastomer protection tool, the pivot arm rests against an adjustable bar applying compression load to the flex element. In an embodiment, the pivot arm may be held in this position by temporary retaining screws threaded into the adjustable bar, or in an alternative embodiment by an external, two-piece retaining ring that extends around the outer sides of the pivot arms. To remove the flexible joint elastomer protection tool, the pivot arm is rotated out and away from the adjustable bar, thus removing the compression of the flex element. This rotation can be actuated in several different ways, such as by using a hydraulic cylinder, a drive screw, or similar methods, which can be manipulated by a typical ROV. One advantage of the described flexible joint elastomer protection tool over earlier designs is its ability to be manipulated or removed by an ROV.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DETAILED DESCRIPTION

Figure 1:
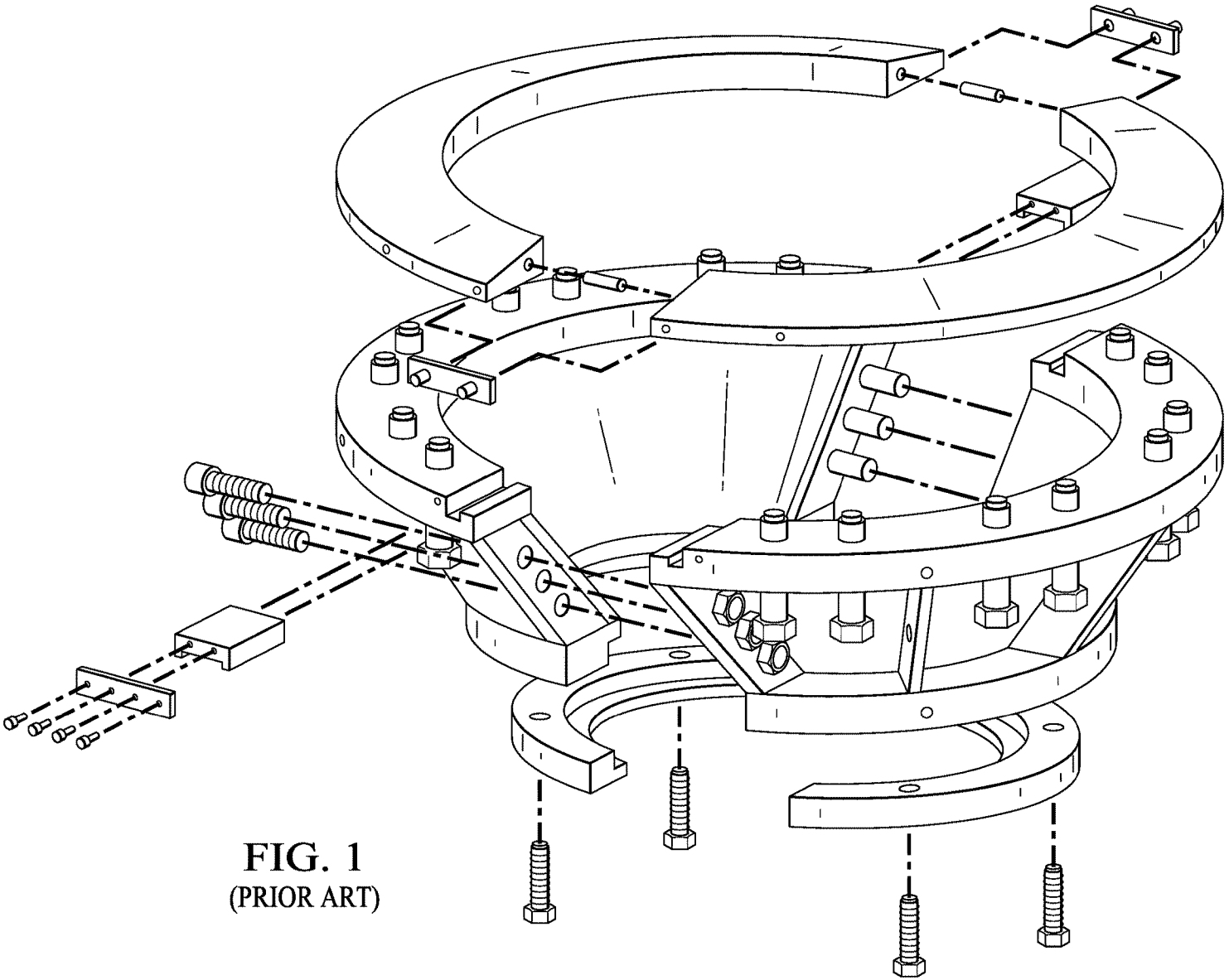
FIG. 1 (PRIOR ART)
FIG. 1 is a side perspective exploded isometric view of a prior art flexible joint elastomer protection tool design.

Exemplary embodiments are illustrated in referenced Figures of the drawings. It is intended that the embodiments and Figures disclosed herein are to be considered illustrative rather than restrictive. No limitation on the scope of the technology that follows is to be imputed to the examples shown in the drawings and discussed herein.

Figure 2:
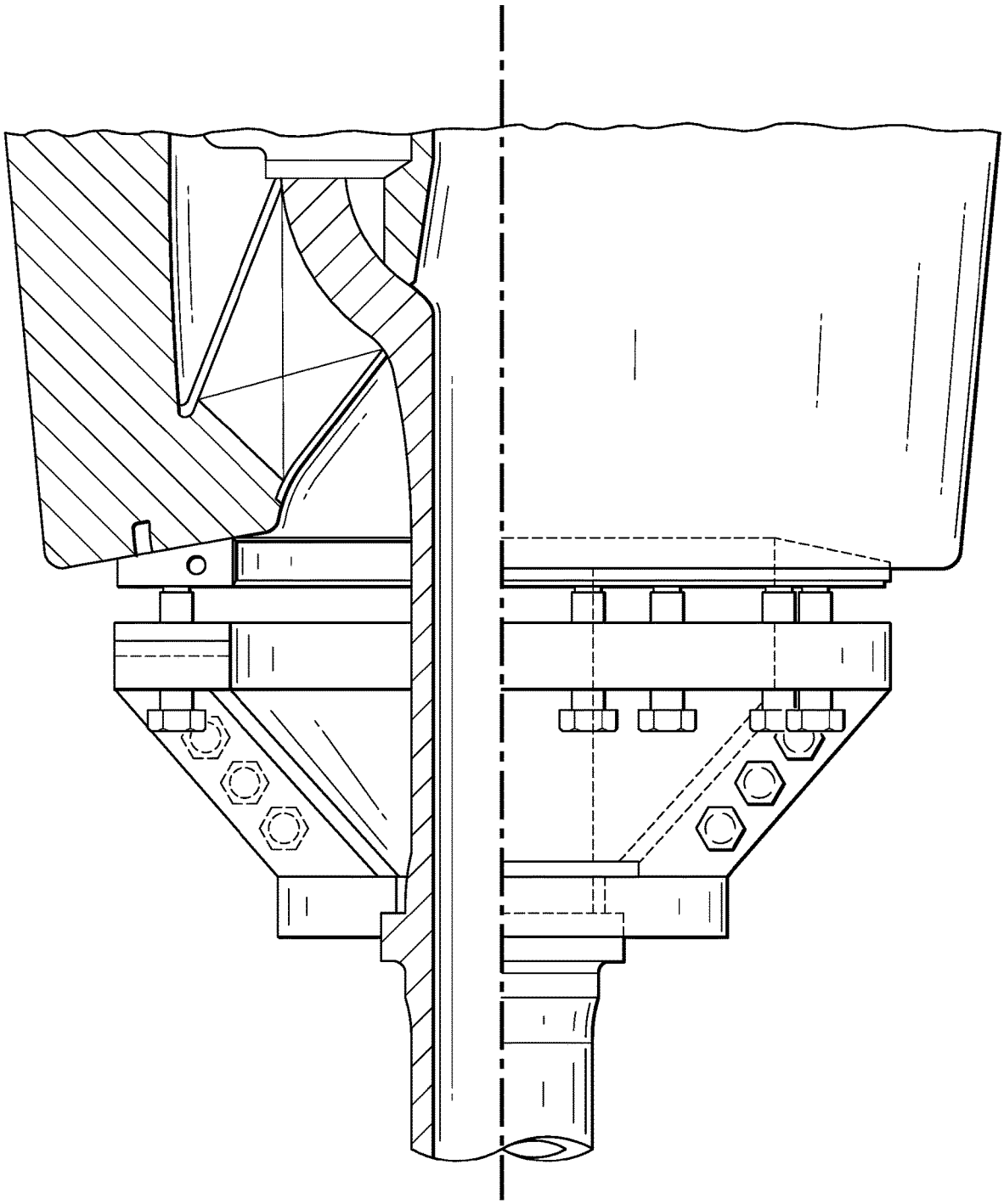
FIG. 2 (PRIOR ART)
FIG. 2 is a side cutaway view of a prior art flexible joint elastomer protection tool design.

FIG. 1 shows an exploded isometric view arrangement and FIG. 2 shows a side cutaway view of a prior flexible joint elastomer protection tool design and how it interfaces with the flexible joint. When the jacking bolts of the flexible joint elastomer protection tool are tightened, they exert an upward force against the bottom of the body of the flexible joint. At the same time, they exert a downward force on the extension of the flexible joint. This results in compressing the flexible joint elastomer layers, also referred to as the flex element of the flexible joint. One problem with this and similar prior flexible joint elastomer protection tool designs is that they are composed of many parts and weldments. Further, a problem with the jacking bolts of this prior flexible joint elastomer protection tool design and similar prior designs, is that they require up to 6000 ft-lbs to torque into and out of position, which at this point in time is well beyond the capability of most ROVs.

Figure 3:
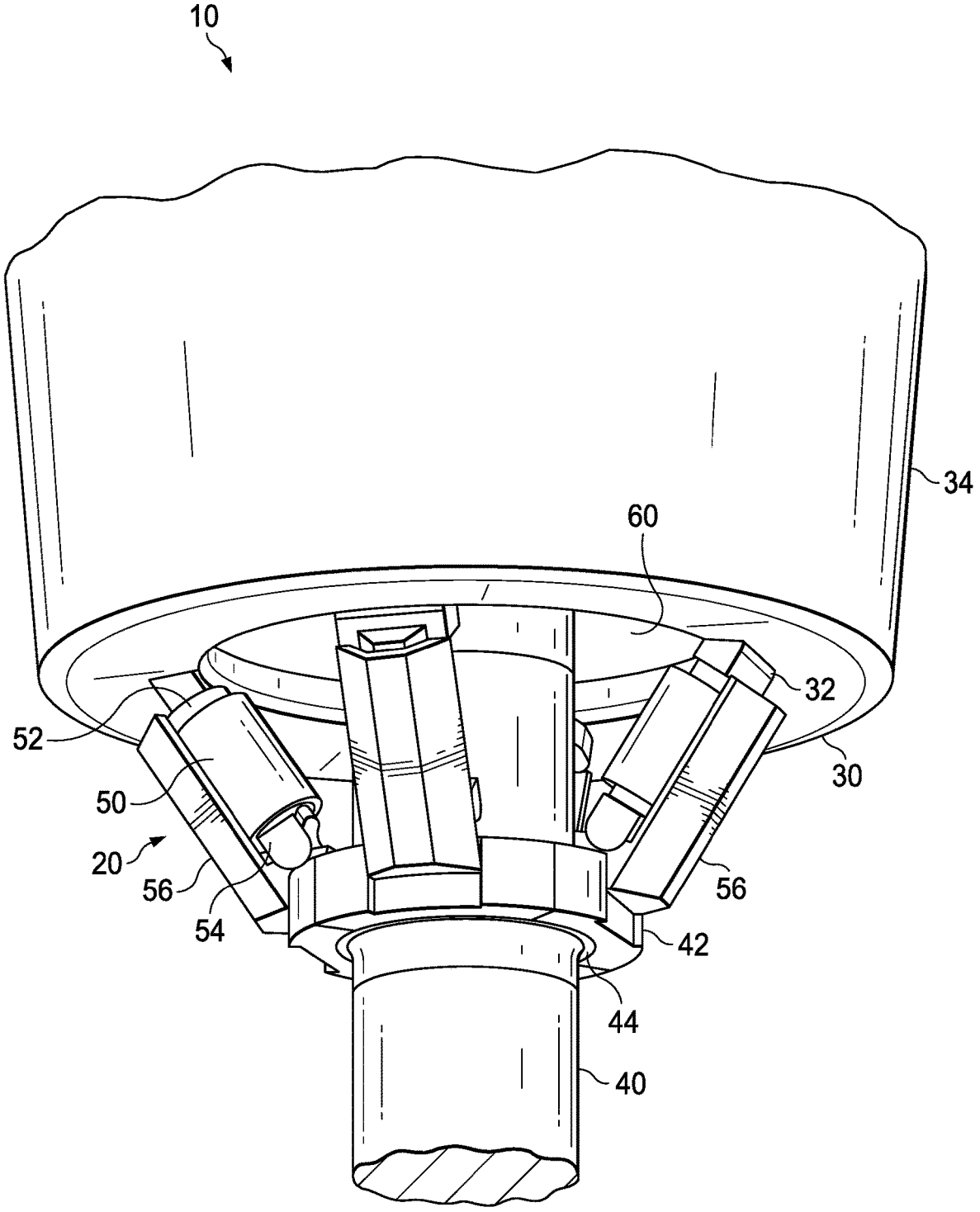
FIG. 3 is a side perspective view of an embodiment of an improved flexible joint elastomer protection tool configured with four independent legs, the tool shown in the closed position in this view.
Figure 4:
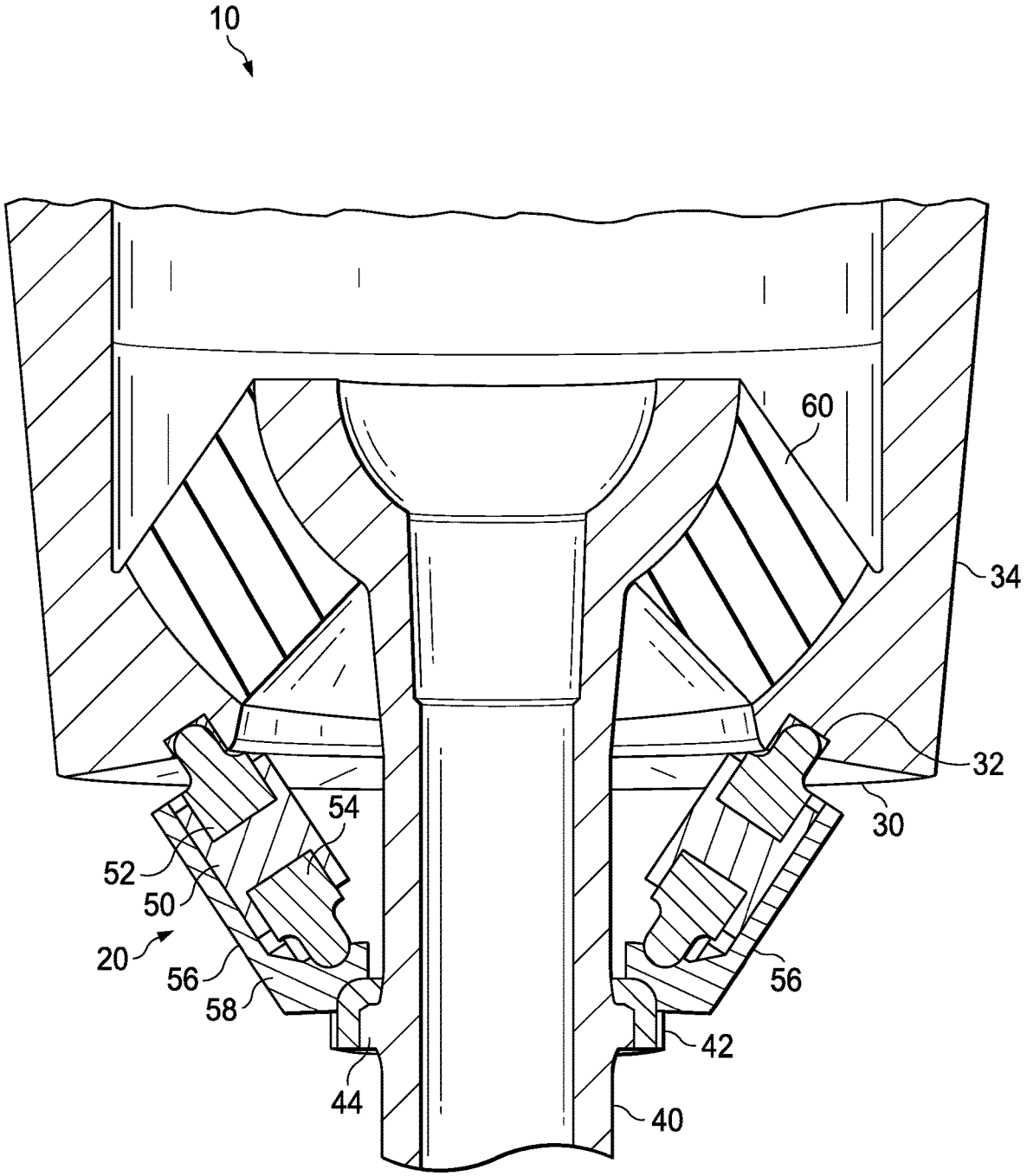
FIG. 4 is a side cross-sectional view of an embodiment of an improved flexible joint elastomer protection tool configured with four independent legs, the tool shown in the closed position in this view.

Referring to FIG. 3, a side perspective view of an embodiment of the improved flexible joint elastomer protection tool 10 is shown. The same embodiment is shown in FIG. 4 as a side cross-sectional view. Referring to both FIGS. 3 and 4, in this embodiment, four independent legs 20 are configured and attached between a flexible joint 30 and a flexible joint extension 40. In an embodiment, the number of independent legs 20 can be increased or decreased based on requirements of a particular job site and tool. Each independent leg is comprised of an adjustable bar 50, a top bar 52, a bottom bar 54, and a pivot arm 56.

For the tool to work properly, the flex element must be pre-compressed precisely, possibly to within a range of a few thousandths of an inch, to prevent damage to the element when it is deployed. As a result, it may be desired to carefully adjust the amount of compression provided by the flexible joint elastomer protection tool. Adjustable bar 50 is one way to achieve such precise adjustability. As shown in greater detail in FIGS. 9A-9C, adjustability can be achieved by using one or more threaded connections (such as acme threads) between the adjustable bar and one or both of the top bar and the bottom bar. The adjustable bar 50 (or 50*a* or 50*b*), acts as a turn buckle. By spinning the adjustable bar piece, the length of the assembly is changed. Once the desired length is achieved, in an embodiment, the assembly can be welded together to prevent movement, after which holes for the cylinder or safety bolt, if configured, can be drilled if needed. Adjustability can alternatively be achieved by placing shims beneath the top and bottom bars.

Adjustable bar 50 is not necessary for the operation of the flexible joint elastomer protection tool. Rather than adjusting the length of the assembly, adjustable bar 50 could be replaced by a similar component that had been machined precisely to the exact required length for a particular configuration of flexible joint.

Referring again to FIGS. 3-5, in this embodiment, the top bar 52 is configured to connect to a flexible joint body insert 32 which is shown inset into a flexible joint body 34. The assembly comprising the top bar 52, adjustable bar 50, and bottom bar 54 is configured to connect to the pivot arm 56 with a lower portion of the bottom bar 54 configured to be positioned inset into a lower receiving portion 58 of the pivot arm 56. The pivot arm 56 is configured to connect to a collar support 42 mounted on flexible joint extension 40. In an embodiment the collar support 42 may be connected to a collar support seat 44 of the flexible joint extension 40.

Referring to FIGS. 3 and 4, an embodiment of the improved flexible joint elastomer protection tool 10 is shown in its actuated or "locked" position. In this position, the tool 10 is preloaded and flex element 60 is substantially compressed. Once the flexible joint elastomer protection tool 10 has been installed and actuated or locked, the flex element 60 acts similarly to a compressed spring which is pushing the flexible joint body 34 downward while pushing the flexible joint extension 40 upward. Due to the design and geometry of tool 10, this actuated (or closed) position is self-locking, in that no other mechanism is necessary to keep the tool in this position. This stability is due to the fact that the cam assembly comprised of pivot arm 56, adjustable bar 50, top bar 52, and bottom bar 54 has been rotated past the "over-center" position. Due to the angular orientation of those components in relation to the central axis of flexible joint 34 and flexible joint extension 40, the axial force imparted by the compression of flex element 60 cannot cause rotation or radial displacement of pivot arm 56, adjustable bar 50, top bar 52, or bottom bar 54.

Figure 5:
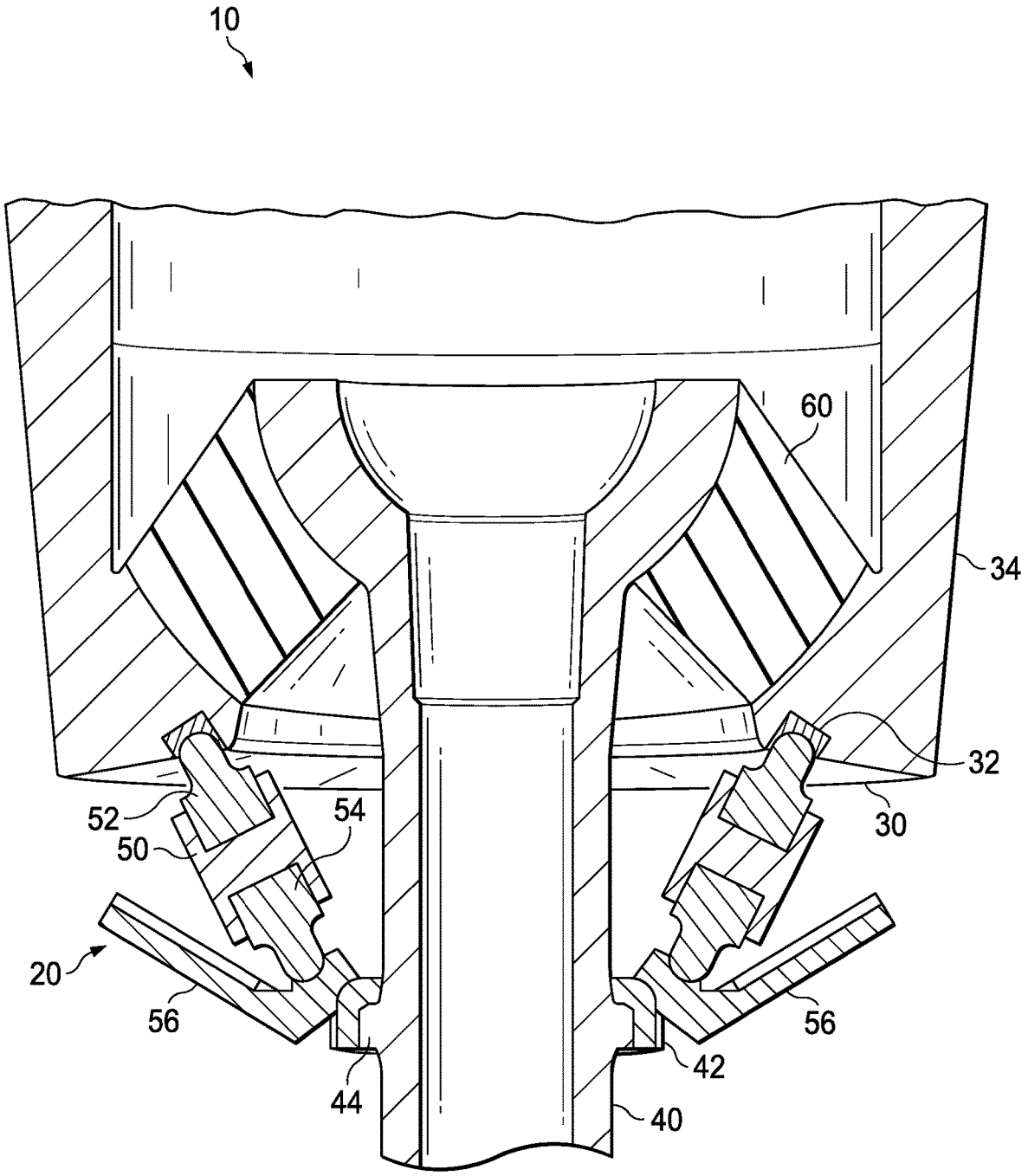
FIG. 5 is a side cross-sectional view of an embodiment of an improved flexible joint elastomer protection tool configured with four independent legs, the tool shown in the open position in this view.

Referring to FIG. 5, an embodiment of the improved flexible joint elastomer protection tool is shown in an "open" or "relaxed" position. In this position, there is no compression on the flex element 60 and there is substantially no load anywhere in the system. Further, for this embodiment, in this position, the extension can be configured to be roughly 0.25 inches higher than in the closed position.

To move from the position shown in FIG. 5 to the position shown in FIGS. 3-4, thus actuating the tool and compressing flex element 60, each of the configured pivot arms 56 are rotated inwards until they are face to face with their respective adjustable bar 50. As described above, rotating the pivot arm 56 inwards will result in compression of flex element 60. Conversely, to deactivate the tool 10 and remove the tool 10, each pivot arm 56 is rotated out, away from its respective adjustable bar 50. In the illustrated embodiment, in the open position, there is nothing holding the parts together, so the tool will fall apart when opened.

Figure 6:
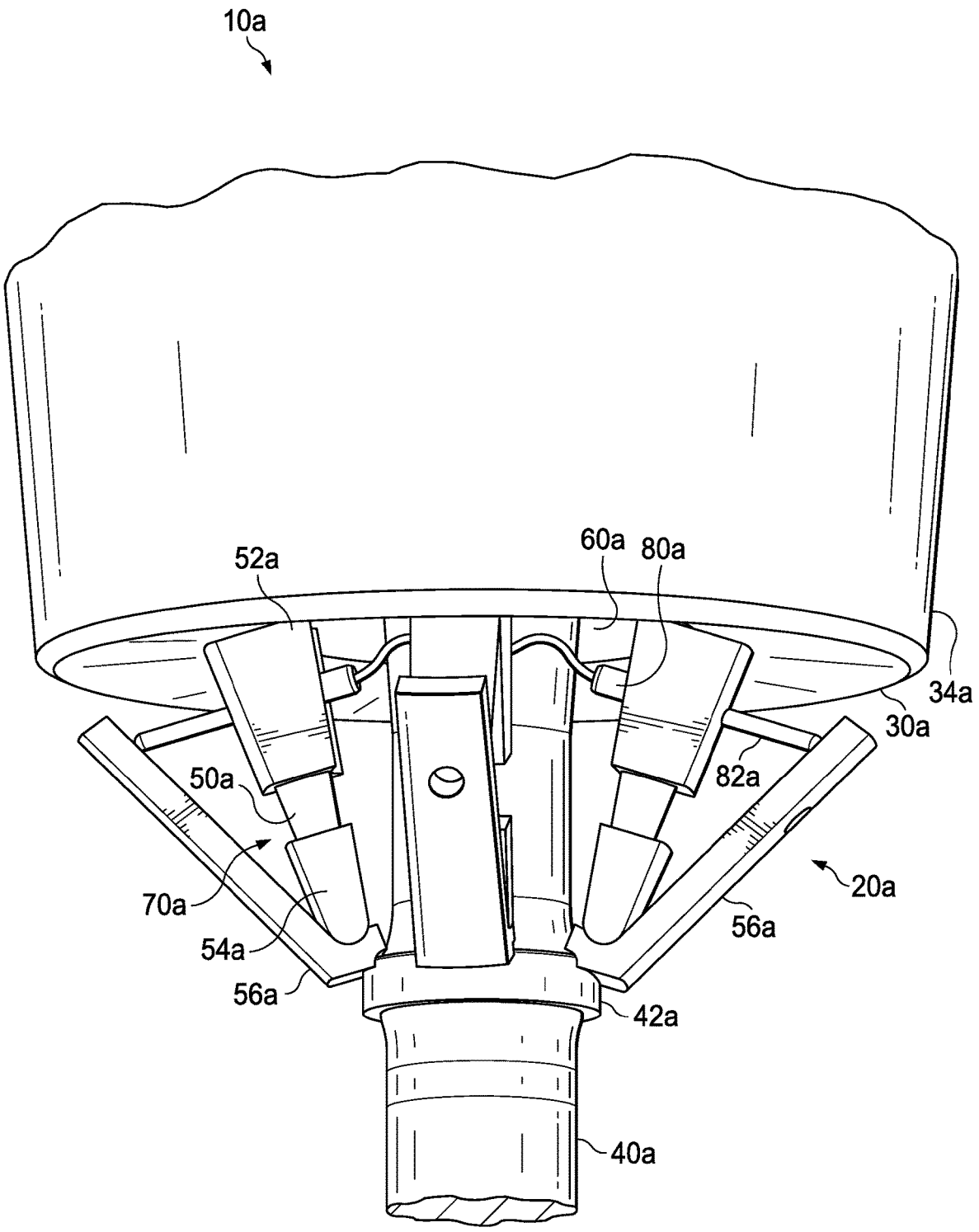
FIG. 6 is a side perspective view of an alternative embodiment of an improved flexible joint elastomer protection tool configured with four independent legs and actuators configured, the tool shown in the open position in this view.
Figure 7:
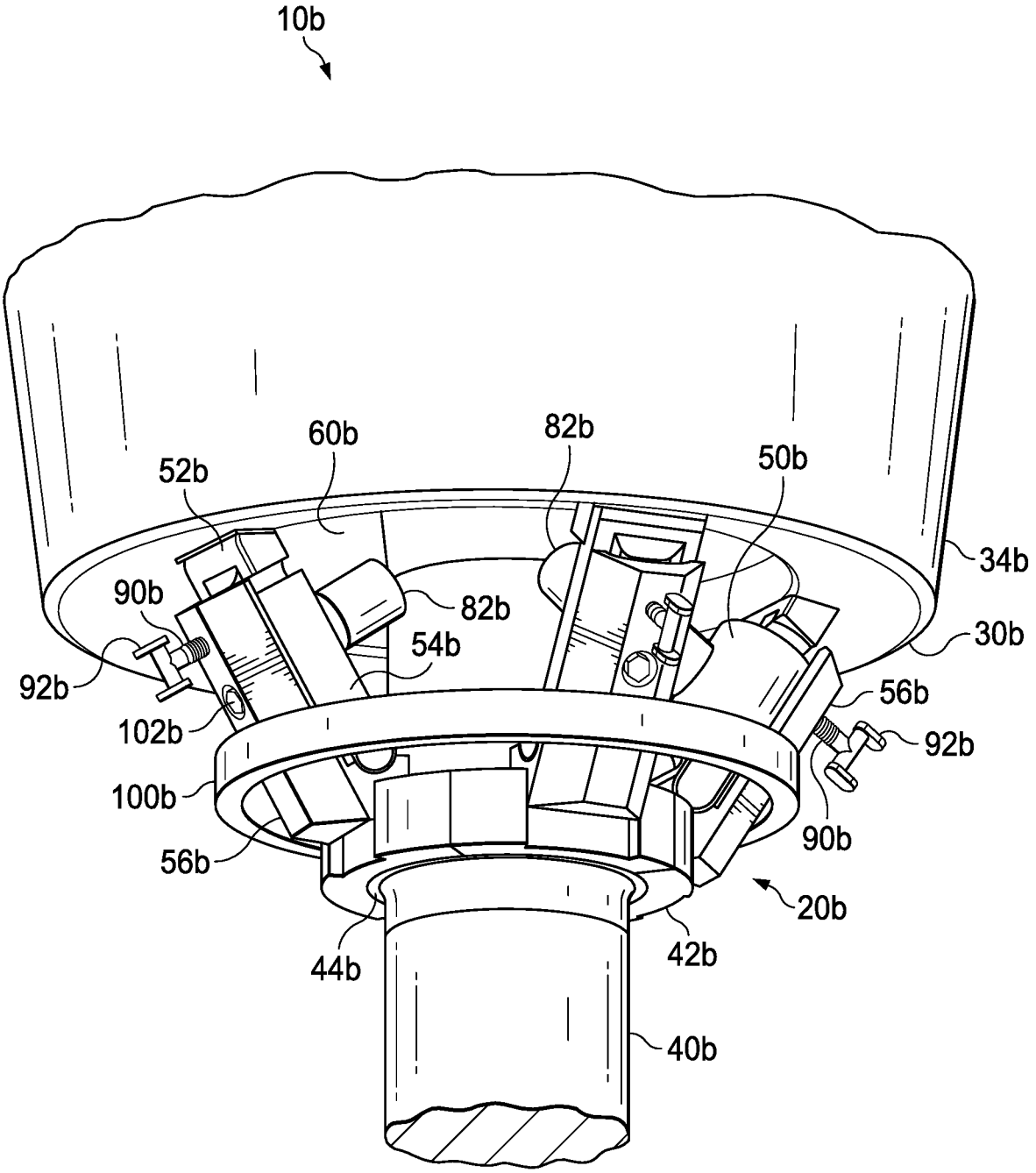
FIG. 7 is a side perspective view of an alternative embodiment of an improved flexible joint elastomer protection tool configured with four independent legs, the tool is shown in the closed and locked position in this view, the embodiment in this view is configured with multiple optional locking elements.
Figure 8:
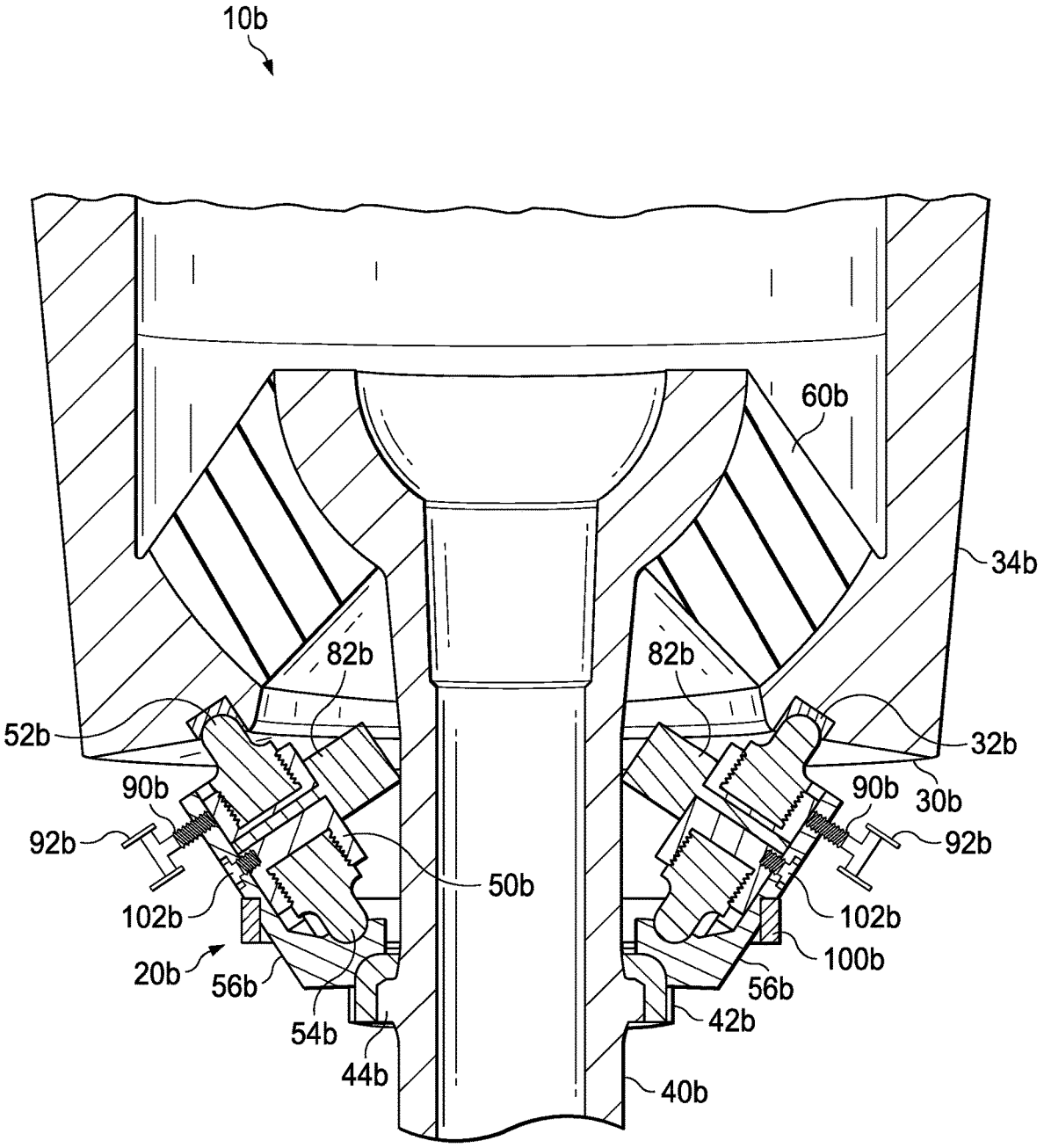
FIG. 8 is a cross-sectional view of an alternative embodiment of an improved flexible joint elastomer protection tool configured with four independent legs, the tool is shown in the closed and locked position in this view, the embodiment in this view is configured with multiple optional locking elements.

There are multiple possible ways to actuate the described improved flexible joint elastomer protection tool. Referring to FIG. 6, an embodiment of the improved flexible joint elastomer protection tool 10*a* is illustrated. Through the use of an adjustable arm 70*a* and camming actions, a large amount of axial force on flex element 60*a* can be generated by rotating pivot arm 56*a*. The force required to rotate pivot arm 56*a* is very small compared to the axial force produced. A hydraulic system local to the FJ may include individual hydraulic actuators and cause them to actuate independently or collectively, via either self-actuation or upon the receipt of an actuation command or other triggering action. Similarly, the FJ may include a local electronic actuation system. Hydraulic actuators 80*a* are configured in the embodiment shown in FIG. 6, though electronic actuators or other actuation mechanisms may be substituted for the hydraulic actuators 80*a* that are shown configured in this embodiment. The hydraulic actuators 80*a* either push or pull pivot arm 56*a* in or out. Each adjustable arm 70*a* can be configured to include: an upper section 52*a*, a middle section 50*a*, and a lower section 54*a*. The actuators 80*a* may be linked to all legs 20*a* of the tool by a rod 82*a*. In an embodiment, rods 82*a* can be configured such that they may be actuated by an ROV in a manner that would be apparent to one of ordinary skill in the art. The force ratio between the axial force acting on the flexible joint extension 40*a* and the axial force on the hydraulic actuators 80*a* can be designed to be higher than around 50:1. For this configuration, if the hydraulic actuator 80*a* pushes with about 5 kips of force, the reacting force pushing on the extension 40*a* will be about 250 kips.

Although the position shown in FIGS. 3-4 is self-locking, in an embodiment; supplemental fasteners can be used to maintain the tool in the closed position as a secondary feature to prevent the tool from opening inadvertently. Examples of such supplemental fasteners are illustrated in FIGS. 7-9C. In one potential embodiment, a locking bolt 102*b* may be configured locking each pivot arm 56*b* to its respective adjustable bar 50*b*. An ROV with a socket wrench can unscrew each of the locking bolts 102*b*. In another potential embodiment, a locking ring 100*b* may be configured as an additional mechanism to secure the pivot arms 56*b* from moving prematurely. The locking ring 100*b* can be configured as a one piece or two piece ring, in the embodiment shown, the locking ring 100*b* is configured as a two piece ring. On one side is a hinge, and on the opposite side is a locking device (not shown) such as a threaded fastener that can be unlocked or opened by an ROV. When the locking ring 100*b* is unlocked, it can then easily be removed by the ROV or it may simply fall off.

Figure 9A:
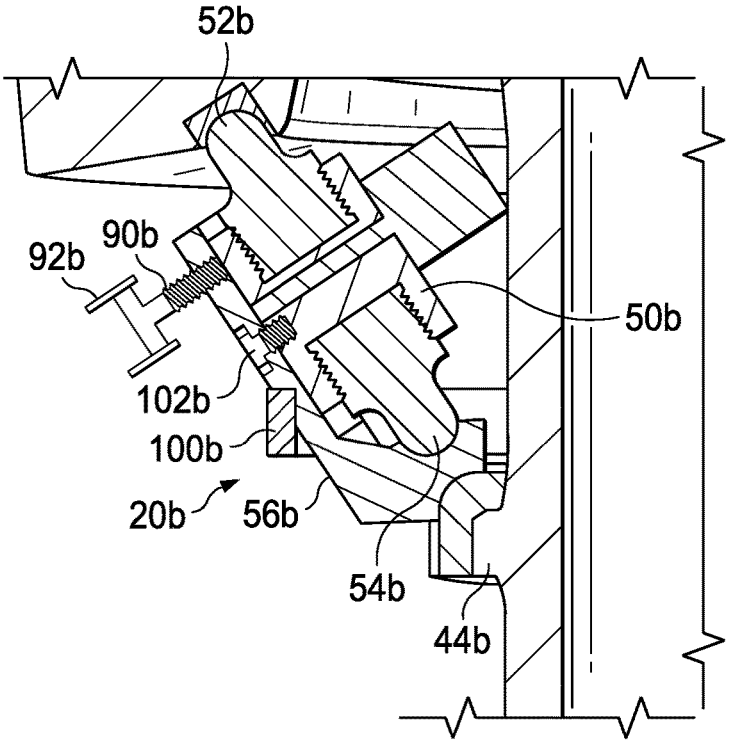
FIG. 9A is an enlarged cross-sectional view of an alternative embodiment of an improved flexible joint elastomer protection tool showing an enlarged portion of one of the independent legs, the tool is shown in the closed and locked position in this view, the embodiment in this view is configured with multiple optional locking elements.
Figure 9B:
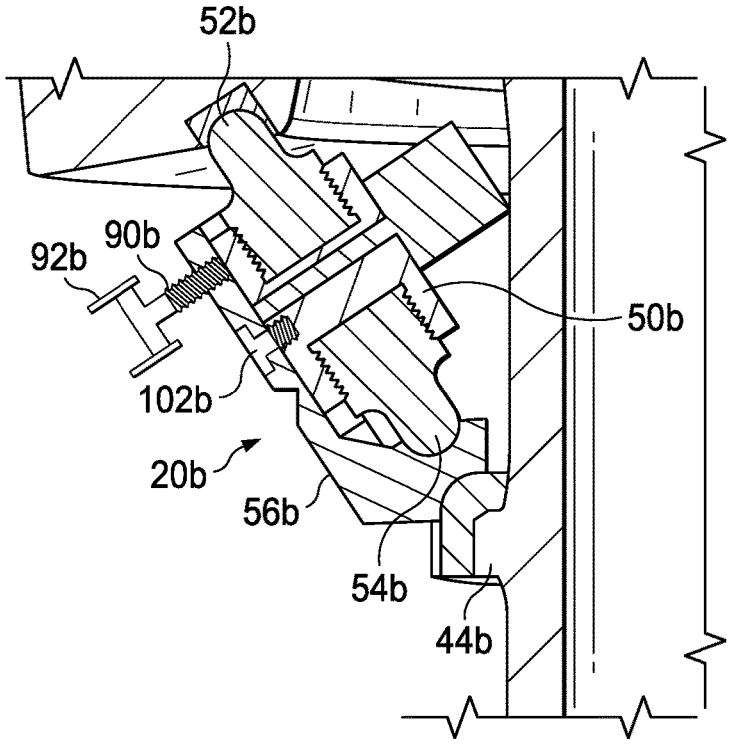
FIG. 9B is an enlarged cross-sectional view of an alternative embodiment of an improved flexible joint elastomer protection tool showing an enlarged portion of one of the independent legs, the tool is shown in the closed and unlocked position in this view, the multiple optional locking elements shown in FIG. 9A have been removed in this view.
Figure 9C:
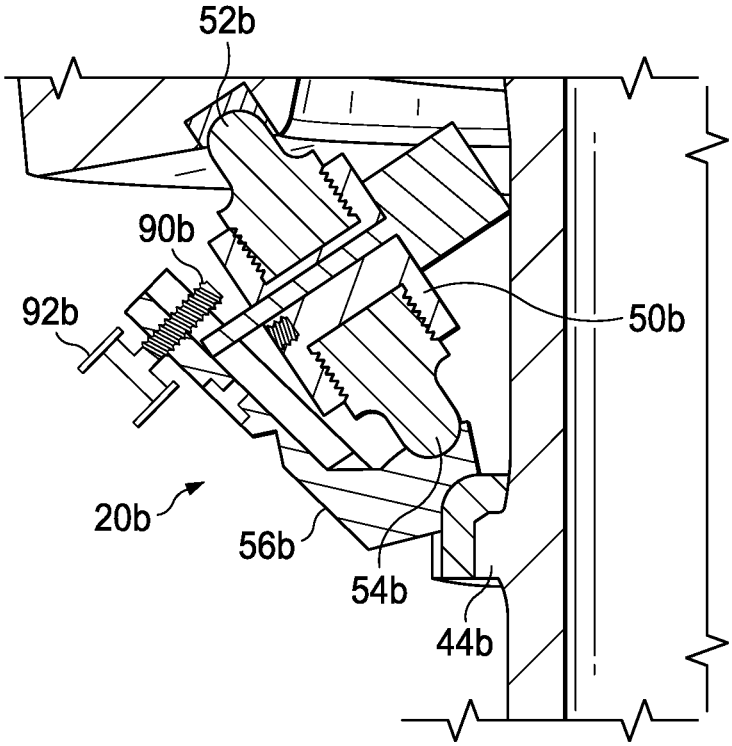
FIG. 9C is an enlarged cross-sectional view of an alternative embodiment of an improved flexible joint elastomer protection tool showing an enlarged portion of one of the independent legs, the tool shown in the open position in this view, the embodiment in this view is shown with the multiple optional locking elements removed, drive screws actuated, and hydraulic cylinders actuated.

FIGS. 9A-9C show one possible sequence for removing the optional locking elements, such that flexible joint elastomer protection tool 10*b* may be moved to its open position. FIG. 9A shows an enlarged portion of one of the independent legs of the tool 10*b*, the leg 20*b* shown is in the closed and locked position in this view, the embodiment in this view is configured with multiple optional locking elements as described above. In FIG. 9B, the multiple optional locking elements shown in FIG. 9A have been removed. An ROV can be configured with tools that allow it to remove the locking ring 100*b* and the locking bolt 102*b*.

The embodiment shown in FIGS. 7-9C is also shown configured with drive screw 90*b* to cause outward rotation of pivot arm 56*b*, thus moving flexible joint elastomer protection tool 10*b* to its open position. The drive screws 90*b* can be pre-installed into the pivot arm 56*b*, and, in an embodiment, can be configured with ROV attachments 92*b*. The drive screws 90*b* are threaded into pivot arms 56*b*, and as they are turned, push against adjustable bars 50*b*, causing the pivot arms 56*b* to rotate out away from the central axis of the flexible joint. Again, with a designed power amplification of around 50:1, the required torque to turn the drive screws 90*b* will be less than about 125 ft-lbs, which is well within the typical capability of current ROVs.

Hydraulic, pneumatic, electric cylinders, or a combination of cylinders may also be configured in an embodiment of the flexible joint elastomer protection tool. FIGS. 7, 8, and 9A-9C, show optional electric cylinders configured. In this embodiment or in other similar embodiments, the ROV will "stab in" to the localized electric system and power the actuation of the electric cylinders 82*b*. As shown in FIG. 9C, cylinder 82*b* may be used in conjunction with, or instead of, drive screw 90*b* to cause pivot arm 56*b* to rotate outward, thus opening the tool and allowing decompression of the flex element. Alternatively, in a hydraulic or pneumatic system, the ROV can similarly "stab in" to the localized system to provide the power needed to actuate the respective cylinders. The location of the cylinders in a given system can vary, as long as the configured location will cause the pivot bar to rotate outward as described.

In summary, the improved flexible joint elastomer protection tool design allows a flexible joint elastomer protection tool to be installed or taken apart by an ROV, which cannot be achieved using existing flexible joint elastomer protection tool technology. An additional benefit of the improved tool is that it has fewer parts and no weldments. Another benefit of the improved tool is that it can be reused. For example, by replacing just the body insert and the collar support, the same flexible joint elastomer protection tool can be used on multiple flexible joint sizes.

Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description.

The invention claimed is:

1. A flexible joint elastomer protection apparatus comprising:

one or more legs comprising a pivot arm, a middle portion, a top bar, and a lower bar, said top bar configured to connect to a substantially annular lower surface of a flexible joint, said lower bar configured to connect to the pivot arm, and the pivot arm configured to rotatably connect to a substantially cylindrical flexible joint extension member with a longitudinal axis that is substantially orthogonal to the lower surface of the flexible joint, such that the pivot arm may be in a first position, in which it is rotated away from the middle portion of the leg and exerts substantially no axial force on the lower surface of the flexible joint, or may be in a second position, in which it is rotated towards the middle portion of the leg and exerts, through the top bar, an axial force on the lower surface of the flexible joint.

2. The apparatus of claim 1, wherein the middle portion of the leg comprises a bar with a length that is adjustable.

3. The apparatus of claim 2, wherein the bar comprising the middle portion of the leg comprises a threaded connection between at least one of the top bar and the lower bar, such that the length of the pivot arm may be varied by rotating the adjustable bar about its central axis.

4. The apparatus of claim 1, further comprising:

a flexible joint extension collar support, the flexible joint extension collar support configured to attach between the lower end of the pivot arm and the flexible joint extension.

5. The apparatus of claim 1, wherein, once the pivot arm is rotated to the second position, it is configured to remain in said position until a remote operated vehicle causes the pivot arm to move to the first position.

6. The apparatus of claim 1, further comprising a supplemental fastener configured to maintain each of the pivot arms in the second position.

7. The apparatus of claim 6, wherein said supplemental fastener comprises one or more threaded bolts configured to removably connect the pivot arm to the middle portion of the leg when the pivot arm is in the second position.

8. The apparatus of claim 6, wherein said supplemental fastener comprises a locking ring configured to encircle and engage the leg when the pivot arm is in the second position.

9. The apparatus of claim 4, wherein the flexible joint extension member includes a flexible joint extension collar support seat.

10. The apparatus of claim 1, further comprising one or more hydraulic actuators configured to cause the pivot arm to rotate such that the arm moves between the second and first positions.

11. The apparatus of claim 10, further comprising a remote operated vehicle hydraulic connection receiver, such that a remote operated vehicle may connect to the receiver and actuate the hydraulic actuator.

12. The apparatus of claim 1, wherein the apparatus comprises four legs, which are substantially equiangularly separated around the circumference of the flexible joint.

13. The apparatus of claim 1, wherein the one or more pivot arm is configured with a drive screw that, when actuated, causes the pivot arm to move from the second position to the first position.

14. The apparatus of claim 13, wherein said drive screw is configured such that it may be actuated by a remote-operated vehicle.

15. A method of deploying a flexible joint on a sea floor, comprising the following steps:

coupling a flexible joint elastomer protection apparatus to the flexible joint, the apparatus comprising:

one or more legs comprising a pivot arm, a middle portion, a top bar, and a lower bar, said top bar configured to connect to the flexible joint, said lower bar configured to connect to the pivot arm, and the pivot arm configured to rotatably connect to a flexible joint extension member, such that the pivot arm may be in a first position, in which it is rotated away from the middle portion of the leg and exerts substantially no axial force on the flexible joint, or may be in a second position, in which it is rotated towards the middle portion of the leg and exerts, through the top bar, an axial force on the flexible joint;

rotating the pivot arm from the first position to the second position, thus compressing the elastomeric flex element within the flexible joint;

transporting the flexible joint, with the flexible joint elastomer protection apparatus installed, to the sea floor.

16. The method of claim 15, wherein the middle portion of the leg comprises an adjustable bar.

17. The method of claim 16, wherein the method further comprises adjusting the adjustable bar such that rotating the pivot arm from the first position to the second position exerts a desired amount of axial force on the flexible joint.

18. The method of claim 16, where in the adjustable bar comprises a threaded connection between at least one of the top bar and the lower bar, such that the length of the pivot arm may be varied by rotating the adjustable bar about its central axis.

19. The method of claim 18, where in the method further comprises rotating the adjustable bar about its central axis, such that rotating the pivot arm from the first position to the second position exerts a desired amount of axial force on the flexible joint.

20. The method of claim 15, wherein the step of moving the pivot arm from the second position to the first position is performed by a remote operated vehicle.

21. The method of claim 20, wherein the flexible joint elastomer protection apparatus further comprises a remote operated vehicle hydraulic connection receiver, and the method further comprising the step of a remote operated vehicle connecting to the receiver and actuating the hydraulic actuator.

22. The method of claim 15, wherein the apparatus comprises four legs, which are substantially equiangularly separated around the circumference of the flexible joint.

23. The method of claim 15, wherein the one or more pivot arm is configured with a drive screw that, when actuated, causes the pivot arm to move from the second position to the first position.

24. The method of claim 23, wherein said drive screw is actuated by a remote-operated vehicle.

25. The method of claim 15, wherein the flexible joint elastomer protection apparatus further comprises one or more hydraulic actuators configured to cause the pivot arm to rotate such that the arm moves between the second and first positions.

* * * * *